US007377265B2

(12) United States Patent
Kojima

(10) Patent No.: US 7,377,265 B2
(45) Date of Patent: May 27, 2008

(54) INJECTOR DRIVER AND DRIVE METHOD FOR THE SAME

(75) Inventor: Susumu Kojima, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/778,864

(22) Filed: Jul. 17, 2007

(65) Prior Publication Data

US 2008/0017172 A1 Jan. 24, 2008

(30) Foreign Application Priority Data

Jul. 20, 2006 (JP) ..... 2006-198715

(51) Int. Cl.
*F02M 51/00* (2006.01)

(52) U.S. Cl. ..... 123/490; 123/478

(58) Field of Classification Search ..... 123/490, 123/478, 480, 456; 701/103–105
See application file for complete search history.

(56) References Cited

U.S. PATENT DOCUMENTS 4,173,030 A * 10/1979 Rabe ..... 123/490
4,753,207 A * 6/1988 Wright ..... 123/490
5,400,757 A * 3/1995 Ishibashi et al. ..... 123/490
5,740,783 A * 4/1998 Learman et al. ..... 123/497

FOREIGN PATENT DOCUMENTS

JP 11-351039 A 12/1999
JP 2001-41085 A 2/2001
JP 2003-13783 A 1/2003
JP 2005-259764 A * 9/2005

* cited by examiner

*Primary Examiner*—Hieu T Vo
(74) *Attorney, Agent, or Firm*—Sughrue Mion, PLLC

(57) ABSTRACT

An injector driver and a drive method therefor wherein a reference current signal is generated that is synchronized to an injector valve signal for causing the injector to inject and that has a current increasing tendency substantially equivalent to an injector current waveform for the case in which a low voltage is applied to the injector, a current that flows in the injector is detected as a detected current signal, and the electrical powering of the injector is controlled by comparing the reference current signal with the detected current signal.

13 Claims, 13 Drawing Sheets

IN THE ABOVE, V1<V2<V3

INJECTOR DRIVER AND DRIVE METHOD FOR THE SAME

INCORPORATION BY REFERENCE

The disclosure of Japanese Patent Application No. 2006-198715 filed on Jul. 20, 2006 including the specification, drawings, and abstract, is incorporated herein by reference in its entirety.

BACKGROUND OF THE INVENTION

1. Field of the Invention

The present invention relates to an injector driver, and specifically to an injector driver and a drive method therefor, which drive an injector of an internal combustion engine to which a battery directly supplies power.

2. Description of the Related Art

An electromagnetic fuel injector (hereinafter "injector") is known as a conventional fuel injector in an internal combustion engine mounted aboard a vehicle such as an automobile. The injector includes a nozzle having a fuel injection port, a plunger, on the end of which is formed a valve (valve body), that is inserted into the nozzle and reciprocally moves freely therewithin, a return spring that imparts resilient force in the valve-closing direction to the plunger, and a coil that receives electrical power from a battery and provides electromagnetic force in the valve-opening direction to the plunger. By electrically powering the coil the plunger is pulled inward to move the valve away from the valve seat of the fuel injection port, thereby injecting fuel from the fuel injection port. When the electrical power to the coil is stopped, however, the magnetic attraction by the coil attenuates, and the resilience force of the return spring closes the valve.

In recent years, injectors (fuel injectors) have come to be disposed in the cylinders of gasoline engines to improve the combustion efficiency, and attempts have been made to inject fuel directly into a cylinder. By directly injecting fuel into a cylinder, because gasoline fuel supplied by an injector is entirely supplied to the cylinder, it becomes possible to perform combustion with a value that is closer to the theoretical value, and it is possible to reduce a fuel consumption and to achieve a reduction in NOx and hydrocarbons and the like contained in the exhaust gas.

In the case of direction injection, however, the space into which the gasoline fuel is injected is the space formed by the cylinder block, the piston, and the cylinder head and, if injection during the compression stroke is considered, combustion must be done at a pressure that a much higher than the case of injection into the intake manifold. Also, there is not enough space and time for the fuel to diffuse after it is injected. Under this type of condition, therefore, in order to achieve combustion conditions equivalent to those in past art, it is necessary to make the fuel pressure of the gasoline fuel supplied to the injector high, and to sufficiently diffuse the fuel within the cylinder from the instant of injection. This makes it necessary to perform high-speed drive of the injector to oppose the high fuel pressure, and also to perform accurate control of the fuel injection time. The driving circuit to achieve this must apply a high voltage in a short period of time to the injector (more precisely, to the injector solenoid) and must perform high-speed opening and closing of the needle valve of the injector.

The Japanese Patent Application Publication No. JP-A-11-351039, for example, discloses art wherein, in an injector drive circuit direct cylinder-injection engine, because a high fuel pressure is applied to the injector, a high magnetic attraction is required by the coil of the injector, rather than using battery voltage (+B) drive, the battery voltage (+B) is generally increased to approximately 50 to 200 V by a voltage-boosting unit and applied to the injector to operate the injector, after which a switch is made to a holding current.

In the art disclosed in Japanese Patent Application Publication No. JP-A-11-351039, however, although there are the advantages of the valve opening response time (T0) of the injector being short and the fact that there is no influence from a variation in the battery voltage (+B), it is necessary to use a voltage boosting unit to increase the battery voltage, and necessary to take noise countermeasures because of the use of a high voltage, thereby leading to the problem of an increase cost of the apparatus.

To solve the above-described problem, Japanese Patent Application Publication No. JP-A-2001-41085 discloses art in which, in driving the injector by the battery voltage (+B), a threshold value at which a switch is made to constant current control is changed depending upon the battery voltage (+B), and the threshold value is set smaller the lower is the battery voltage (+B), thereby preventing excessive current when the battery voltage is low.

However, in the case such as in Japanese Patent Application Publication No. JP-A-2001-41085, in which the injector drive current is controlled by the battery voltage (+B) without using a voltage-boosting unit, the voltage applied to the injector is reduced, making it difficult to suppress the variation (or make constant) of the injector valve opening response time T0 because of battery voltage variation and variations characteristic to each cylinder.

The variation of the injector valve opening response time T0 will be described with reference made to FIG. 10 to FIG. 12. FIG. 10 of the accompanying drawings describes the relationship between the voltage applied to the injector and the injector valve opening response time T0. In this drawing, the horizontal axis represents the voltage applied to the injector INJ, and the vertical axis represents the injector INJ valve opening response time T0. The symbol A denotes drive by the battery voltage (+B), and the symbol B denotes drive by the use of a voltage boosting unit.

In the case of driving using a voltage-boosting unit, as described above, even if the applied voltage varies, the span of change ΔT0 of the valve-opening response time T0 of the injector INJ is small, and there is no particular problem. In contrast, when driving using the battery voltage (+B) only, when the voltage applied to the injector INJ varies, the span of change ΔT0 of the valve-opening response time T0 of the injector INJ becomes large. The voltage applied to the injector INJ varies in accordance with variation of the battery voltage (+B) and variation in the coil resistance (including the wiring harness resistance) caused by ambient temperature variations and the elapse of time.

FIG. 11 describes the valve-opening response time T0 of the injector for the case in which the injector is controlled by a constant voltage, and FIG. 12 describes the valve-opening response time T0 of the injector for the case in which the injector is controlled by a constant current. As shown in FIG. 11 and FIG. 12, the current increasing tendency of the current flowing in the injector INJ differs between the case in which a high voltage is applied and the case in which a low voltage is applied. The valve-opening response time T0 of the injector INJ changes greatly depending upon the current increasing tendency of the current flowing in the injector INJ. In this manner, in the conventional constant-voltage control method and constant-current control method in which a voltage-boosting circuit is not used, there is the problem of not being able to suppress variation in the valve-opening response time T0.

SUMMARY OF THE INVENTION

Given the foregoing, the present invention provides an injector driver and a method of driving thereof enabling suppression of variation in an injector valve opening response time of an internal combustion engine with a low-cost configuration.

One aspect of the present invention provides an injector driver for driving an injector of an internal combustion engine to which a battery directly supplies power. The injector driver includes a reference current signal generator that generates a reference current signal that is synchronized to an injector valve signal for causing the injector to inject and that has a current increasing tendency substantially equivalent to an injector current waveform for the case in which a low voltage is applied to the injector; a current detector that detects the current that flows in the injector as a detected current signal; and an electrical power controller that controls the electrical powering of the injector by comparing the reference current signal with the detected current signal.

Another aspect of the present invention provides a driving method of an injector driver for driving an injector of an internal combustion engine to which a battery directly supplies power. This driving method includes generating a reference current signal that is synchronized to an injector valve signal for causing the injector to inject and that has a current increasing tendency substantially equivalent to an injector current waveform for the case in which a low voltage is applied to the injector; detecting the current that flows in the injector as a detected current signal; and controlling the electrical powering of the injector by comparing the reference current signal with the detected current signal.

According to the above described injector driver and driving method thereof, because of generating a reference current signal that is synchronized to an injector valve signal for causing the injector to inject and that has a current increasing tendency substantially equivalent to an injector current waveform for the case in which a low voltage is applied to the injector; detecting the current that flows in the injector as a detected current signal; and controlling the electrical powering of the injector by comparing the reference current signal with the detected current signal, even if the applied voltage of the injector varies, the injector valve opening response time can be controlled substantially constant so that the injector driver of the internal combustion engine and the driving method thereof are able to suppress variation in the valve-opening response time of the injector without using a voltage-boosting circuit and with a low-cost configuration.

BRIEF DESCRIPTION OF THE DRAWINGS

The features, advantages thereof, and technical and industrial significance of the invention will be better understood by reading the following the detailed description of preferred embodiments of the invention, when considered in connection with the accompanying drawings, in which.

DETAILED DESCRIPTION OF THE PREFERRED EMBODIMENTS

In the following description and the accompanying drawings, the present invention will be described in more detail with reference to exemplary embodiments. The constituent elements in the embodiments described below include elements that could easily be conceived of by a person skilled in the art or which are the same thereas.

Figure 1:
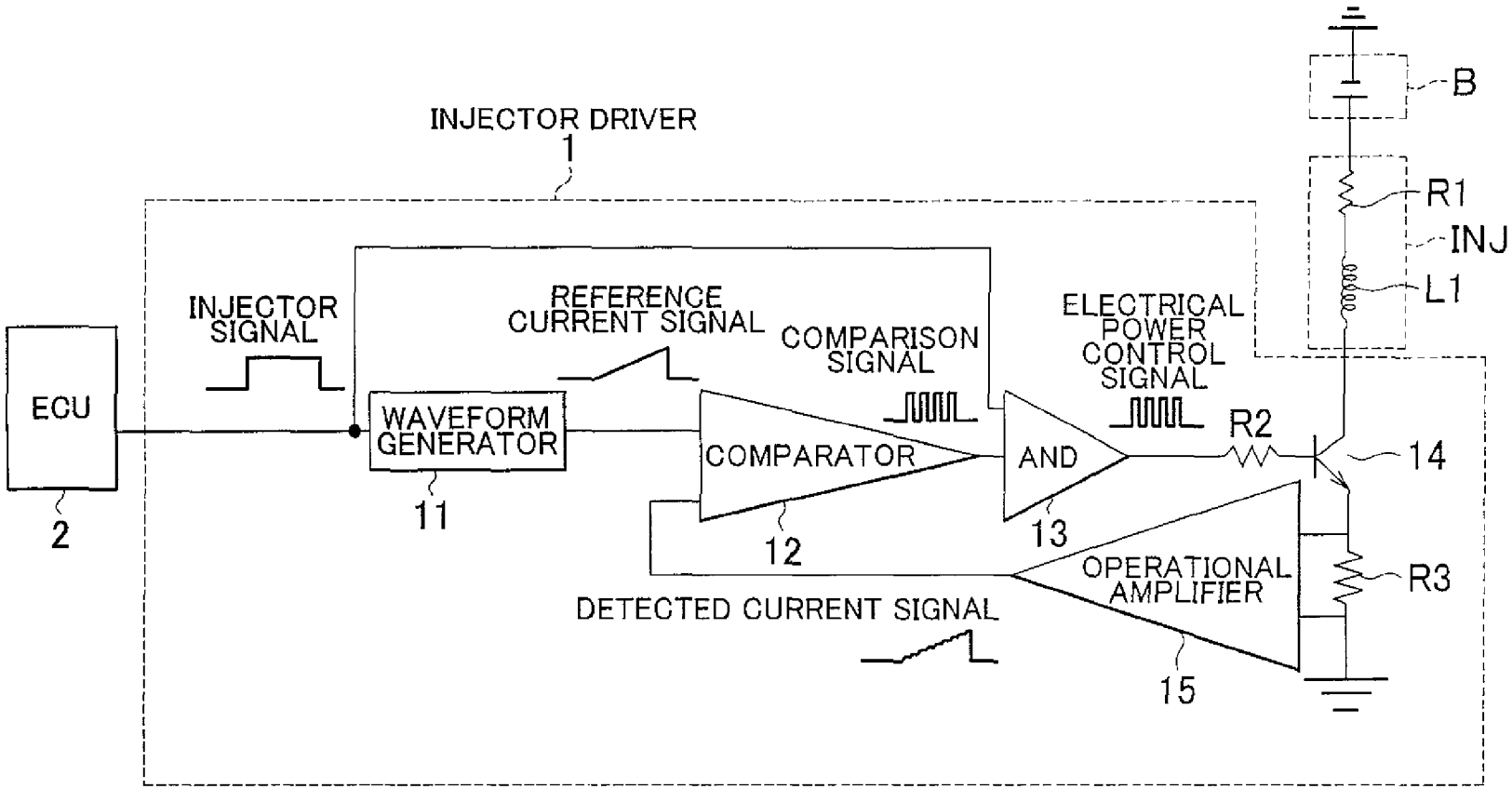
FIG. 1 shows the general configuration of an injector according to a first aspect of the present invention.

The first aspect will now be described. FIG. 1 shows an injector driver that drives (excites) a coil L1 of an injector INJ of an internal combustion engine. In this drawing, the injector INJ is shown as the equivalent circuit made up of the coil L1 and the resistance R1. In this drawing, the coil L1 of one of the injectors of one of the cylinders of the injectors provided in the cylinders is shown as an example of a driver to drive the injector.

In this drawing, the injector driver 1 controls the electrical powering of the coil L1 in response to an injector signal input from an ECU 2. The ECU (engine controller unit) 2 outputs to the injector driver 1 an INJ signal (injection valve signal) determined in response to an engine operating condition such as the throttle opening. A battery B is connected in series with the injector INJ, and supplies the battery voltage (+B) to the injector INJ. The battery voltage (+B) is supplied to the injector INJ from the battery B and the electrical powering of the coil L1 is controlled by the injector driver The injector driver 1 includes a waveform generator 11, a comparator 12, and AND circuit 13, a protective resistance R2, a power transistor 14, a current detection resistance R3, and an operational amplifier (differential amplifier) 15. In this configuration, the waveform generator 11 functions as a reference current signal generator, the comparator 12, the AND circuit 13, and the power transistor 14 function as an electrical power controller, and the current detection resistance 13 and operational amplifier (differential amplifier) 15 function as a current detector.

The waveform generator 11 generates a reference current signal that is synchronized to the INJ signal input from the ECU 2 and that has a current increasing tendency substantially equivalent to an injector current waveform for the case in which a low voltage is applied to the injector INJ, and outputs the generated signal to the comparator 12 and the AND circuit 13. A detailed description of the reference current signal will be presented later.

When the reference current signal is input from the waveform generator 11, the comparator 12 compares it with the detected current signal input from the operational amplifier 15 and outputs to the AND circuit 13 a comparison signal that is L (low) if the detected current signal is equal to or greater than the reference current signal, and H (high) if the detected current signal is greater than the reference current signal. The AND circuit 13 outputs an AND output of the INJ signal input from the ECU 2 and the comparison signal input from the comparator 12 as the electrical power control signal to the gate of the power transistor 14 via the protective resistance R2.

The gate of the power transistor 14 is connected to the AND circuit 13 via the protective resistance R2, the input side thereof is connected to one end of the coil L1, and the output side thereof is connected to the current detection resistance R3. In response to the electric power control signal input to the gate of the power transistor 14, the power transistor 14 electrically powers the coil L1 of the injector INJ. A diode can be connected across the terminals of the power transistor 14 in reverse parallel connection, to prevent reverse current flow.

The current detection resistance R3 is a resistance for detecting the current (injector current) flowing in the coil L1 of the injector INJ, one terminal of the current detection resistance R3 being connected to the output side of the power transistor 14, and the other terminal thereof being connected to ground. The voltage across the terminals of the current detection resistance R3 is a voltage corresponding to the injector current.

The operational amplifier 15 is connected in parallel with the current detection resistance R3, differentially amplifies the voltage across the terminals of the current detection resistance R3, and outputs the amplified signal as the current detection signal to the comparator 12.

Figure 2:
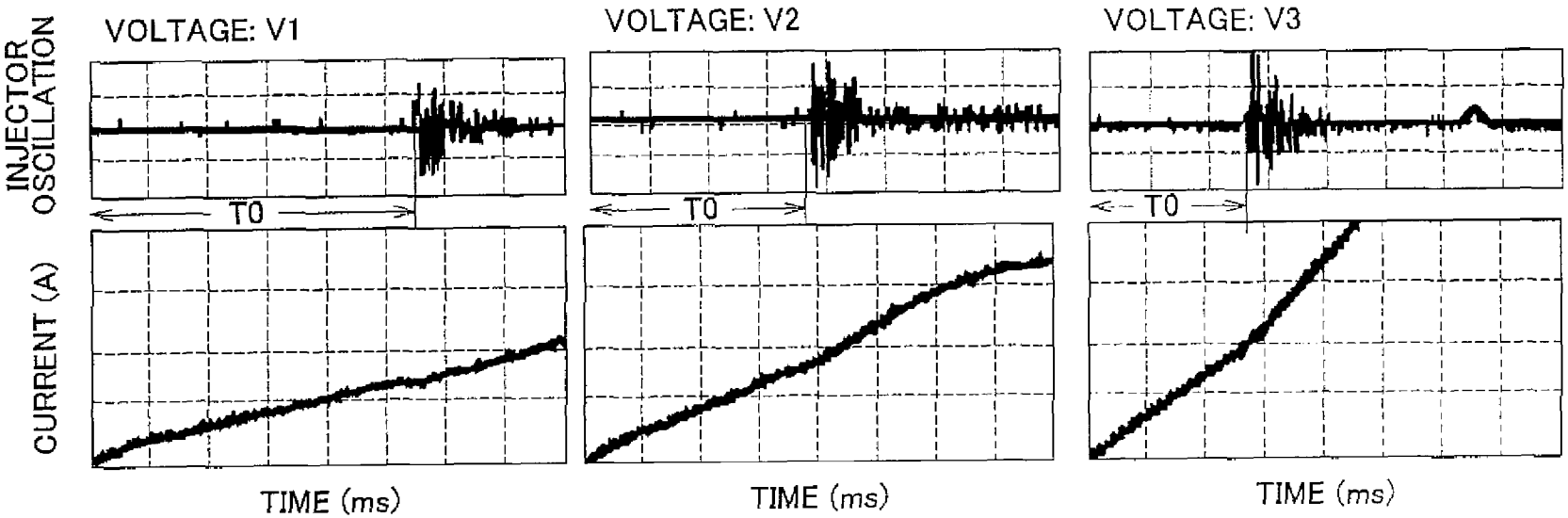
FIG. 2 shows injector current waveforms and injector response when the injector is electrically powered with different voltages applied thereto.

The reference current signal generated by the waveform generator 11 will now be described in detail. FIG. 2 shows injector current waveform passing and the injector INJ response when the voltages V1, V2, and V3 (where V1<V2<V3) input from the ECU 2 are applied to the injector. The increasing tendency of the injector current is different, depending upon the voltage applied to the injector INJ, the increasing tendency being smaller, the lower is the applied voltage. The valve-opening response time T0 is dependent upon the increasing tendency of the injector current, and the valve-opening response time T0 of the injector INJ is larger, the lower is the applied voltage.

In the first aspect of the present invention, regardless of the variation in the voltage applied to the injector INJ (such as battery voltage variation and coil resistance variation), a common reference current signal is generated having an increasing tendency that is substantially equivalent to the case in which the voltage applied to the injector INJ is a low voltage (for example, V1) so that the valve-opening response time T0 is substantially constant, the injector current waveform tracking to this common reference current signal. In this manner, in the first aspect, when the voltage applied to the injector INJ is a low voltage, that is, even in the case in which the reference current signal is generated with the side at which the valve-opening response time T0 of the injector INJ becomes long (at which the valve-opening response worsens) taken as a reference, making the applied voltage high, control is performed so that the valve-opening response time T0 is the same as for a low voltage.

Figure 3:
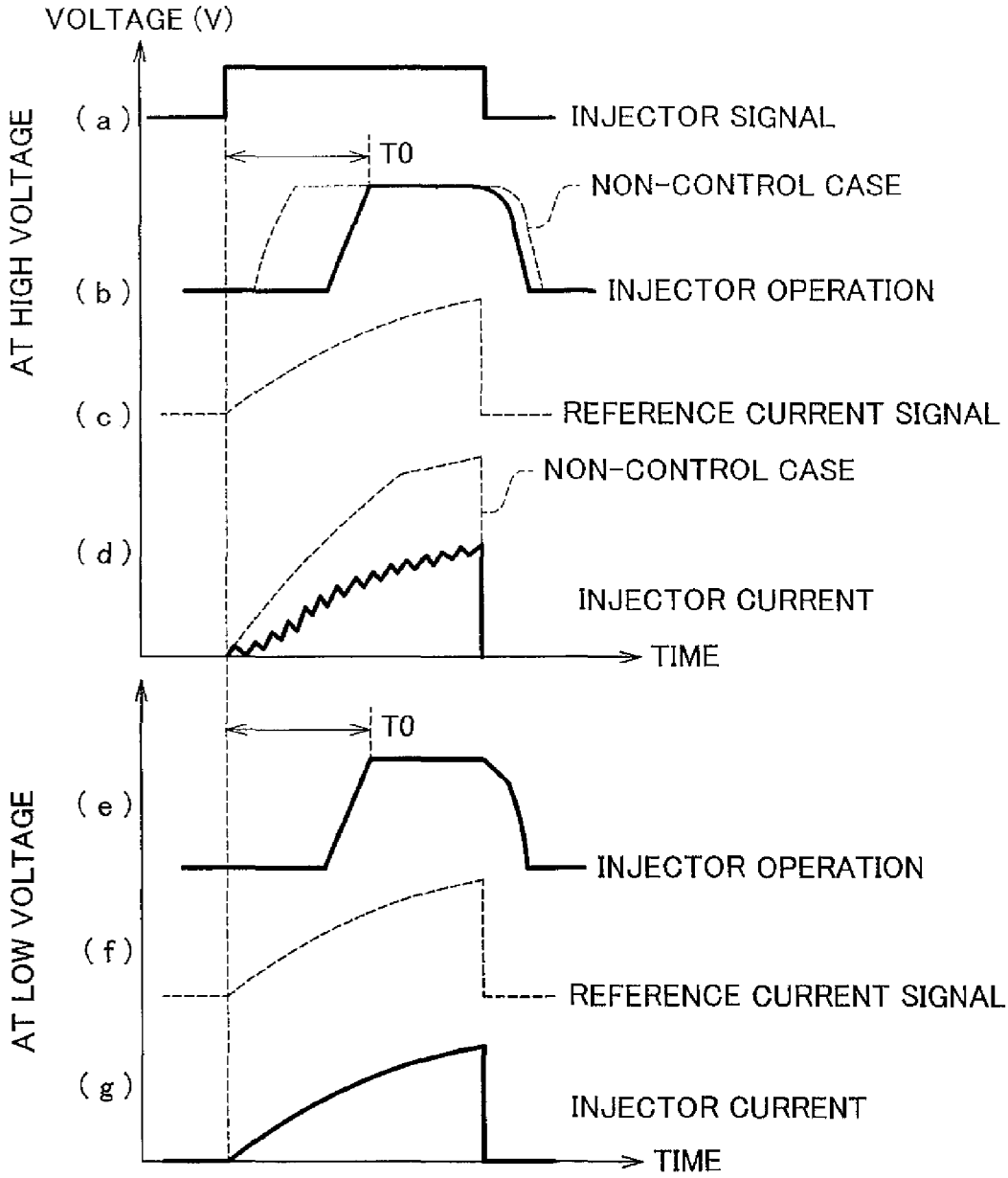
FIG. 3 shows the response of the injector INJ for the cases in which the voltage applied to the injector are low and high.
Figure 4:
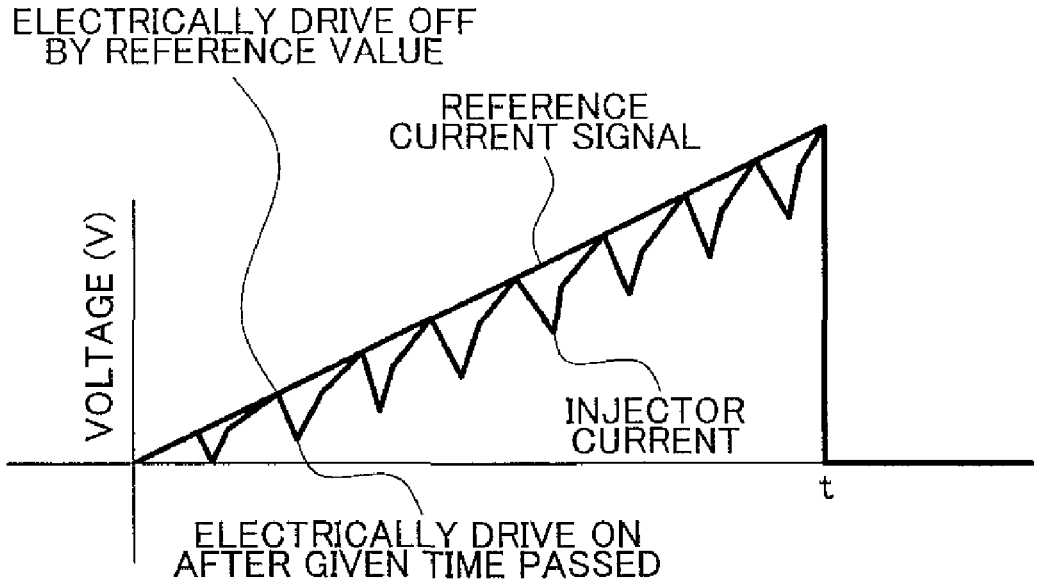
FIG. 4 describes the tracking of the injector current with respect to the reference current signal.

The operation and effect of the injector driver 1 having the configuration shown in FIG. 1 will now be described, with reference made to FIG. 3 through FIG. 5. FIG. 3 describes the drive method of the present invention, and shows the response of the injector INJ for the cases in which a low voltage and a high voltage are applied to the injector. In this drawing, (a) shows the INJ signal, (b) shows the operation of the injector INJ when the applied voltage is a high voltage, (c) shows the reference current signal when the applied voltage is a high voltage, (d) shows the injector current waveform when the applied voltage is a high voltage, (e) shows the operation of the injector INJ when the applied voltage is a low voltage, (f) shows the reference current signal when the applied voltage is a low voltage, and (g) shows the injector current waveform when the applied voltage is a low voltage. FIG. 4 describes the tracking of the injector current with respect to the reference current signal. In this drawing, the horizontal axis represents time, and the vertical axis represents voltage.

Injector driver shown in FIG. 1, at the waveform generator 11 a reference current signal is generated that is synchronized to the INJ signal (refer to FIG. 3(*b*)) input from the ECU 2, this output being made to the comparator 12 and the AND circuit 13. The reference current signal in this case has a waveform having an increasing tendency that is substantially equivalent to that of the injector current waveform when the voltage applied to the injector INJ is a low voltage, this waveform falling (returning to 0 A) at the trailing edge of the INJ signal (the start of electrical powering) and rising at the leading edge of the INJ signal (end of electrical powering) (refer to FIG. 3(*c*) and (*f*)).

At the comparator 12, the reference current signal from the waveform generator 11 is input and the detected current signal responsive to the current flowing in the coil L1 of the injector INJ is fed back. The comparator 12 compares the reference current signal with the detected current signal and outputs to the AND circuit 13 a comparison signal that is L (low) if the detected current signal is equal to or greater than the reference current signal, and H (high) if the detected current signal is less than the reference current signal. The AND circuit 13 outputs an AND output of the INJ signal input from the ECU 2 and the comparison signal input from the comparator 12 as the electrical power control signal to the gate of the power transistor 14 via the protective resistance R2. The reason the electrical power control signal is taken as the AND of comparison signal and the INJ signal is to prevent current from flowing in the coil L1 of the injector INJ when the INJ signal is off. The power transistor 14 is turned on and off in response to the electrical power control signal input from the AND circuit 13 via the protective resistance R2, and causes the electrical powering/non-powering of the coil L1 of the injector INJ. By doing this, the waveform of the current flowing in the coil L1 of the injector INJ (injector current waveform) is controlled to track to the waveform of the reference current signal (refer to FIG. 3(*c*), (*d*), (*f*), and (*g*), and FIG. 4).

In this manner, the injector current shows the same increasing tendency as the case in which the applied voltage is low even if the applied voltage is a high voltage (refer to FIG. 3(*d*) and (*g*)), thereby making the attraction force of the injector INJ constant, enabling a constant injector response time T0 (refer to FIG. 3(*b*) and (*e*)), and preventing variation in the injector response time T0 due to variation of the applied voltage (for example, variation of battery voltage and coil resistance).

Figure 5:
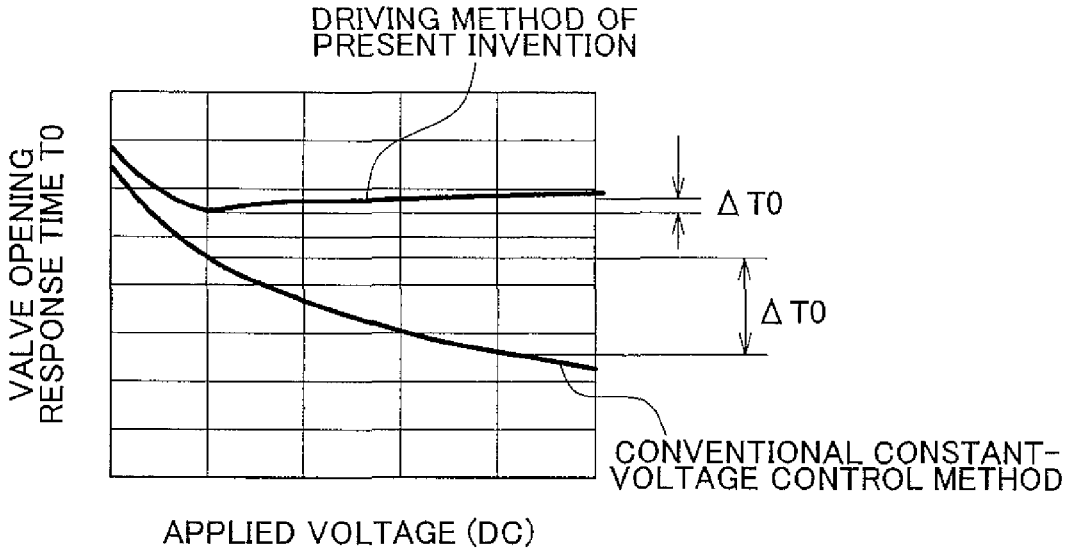
FIG. 5 shows the results of measuring the valve-opening response times for the driving method according to the present invention and the conventional constant-voltage control method.

FIG. 5 shows the results of measuring the valve-opening response times for the driving method according to the present invention and the conventional constant-current control method In this drawing, the horizontal axis represents the voltage applied to the injector INJ, and the vertical axis represents the valve-opening response time T0 of the injector INJ. As shown in FIG. 5, in the drive method of the present invention, compared with the conventional constant-voltage control method, the span of variation ΔT0 of the valve-opening response time T0 of the injector INJ with respect to variation of the applied voltage is greatly reduced, and it has been verified that the drive method of the present invention is effective for controlling the variation of the valve-opening response time T0 of the injector INJ.

Next, the reference current signal will be described with regard to the first to third embodiments of the present invention. The reference current signal current increasing tendency that is substantially equivalent to the injector current waveform for the case in which the voltage applied to the injector INJ is a low voltage, and the waveforms noted in the first to third embodiments described below may also be used.

A configuration that approximates the reference current signal using a triangular wave may be adopted, and this will be described as the first embodiment. As shown in FIG. 2, because the injector current waveforms when the injector INJ is electrically powered are substantially triangular waves (straight lines), it is possible to use a signal that approximates the injector current waveform by a triangular wave as the reference current signal. Because a triangular wave can be generated by a simple configuration of RC elements or the like, this enables a simple and low-cost configuration for the waveform generator 11, enabling a low-cost configuration for the injector driver 1. Furthermore, the waveform approximated is not restricted to being a triangular wave, and can be, for example, a trapezoidal waveform or a curved waveform, and any waveform signal can be used as long as it is possible to evaluate the waveform as being substantially equivalent to the injector current waveform for the case in which the applied voltage is a low voltage.

Figure 6:
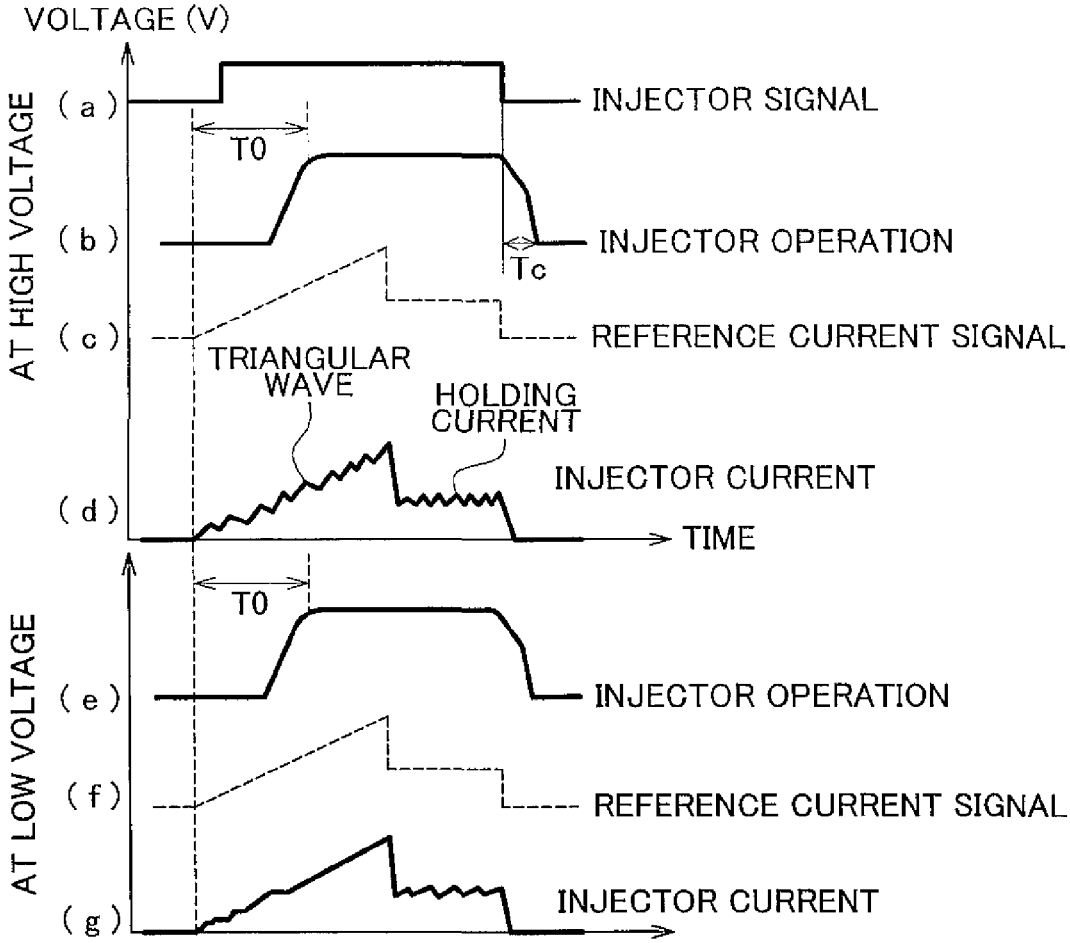
FIG. 6 describes the reference current signal in a second embodiment of the first aspect of the present invention.

FIG. 6 describes the reference current signal in the second embodiment of the present invention. In this drawing, (a) shows the INJ signal, (b) shows the operation of the injector INJ when the applied voltage is a high voltage, (c) shows the reference current signal when the applied voltage is a high voltage, (d) shows the injector current waveform when the applied voltage is a high voltage, (e) shows the operation of the injector INJ when the applied voltage is a low voltage, (f) shows the reference current signal when the applied voltage is a low voltage, and (g) shows the injector current waveform when the applied voltage is a low voltage, and Tc shows the valve-closing response time.

In this drawing, in the case in which the current value that increasing continuously exceeds a certain value (first current value) required for injector INJ operation, the reference current signal may be step-changed to a holding current value (second current value) that is set lower than the certain value (first current value). In this case, in the same manner as in the first embodiment, approximation can be done using a triangular wave until a certain value is reached.

After the injector INJ operates, because the current value becomes excessive, because the excessive current would lead to a worsening of energy consumption and a worsening of the valve-closing response time Tc of the injector INJ, after the injector INJ operates a switch is made to a minimum holding current required to hold the valve open. By doing this, a worsening of energy consumption and a lengthening of the valve-closing response time Tc of the injector INJ can be prevented.

The reference current signal may have a waveform having an increasing tendency that is substantially equivalent to that of the injector current waveform for the case in which the injector INJ is electrically powered under a specific condition (at a low battery voltage (+B) and prescribed operating condition), and this will be described as the third embodiment of the present invention. In this manner, by making the waveform of the reference current signal equivalent to an actual waveform, it is possible to achieve coincidence in the operating state. In this case, the specific condition can be made a condition under which, in the injector INJ and engine, the injector current at an operating condition (at a normal engine rpm) at which the valve-opening response time T0 of the injector INJ is not a problem and the injector current has the slowest rate of rise.

The battery voltage (+B) varies depending upon the engine rpm and the size of the electrical load, and the coil resistance of the injector and the wiring harness resistance also vary with the ambient temperature. With the operating condition of the engine (such as engine rpm and ambient temperature) and the battery voltage (+B) as parameters, the magnetic attraction force of the injector is set beforehand so that the injector INJ can operate under the condition of the slowest rise in injector current. Under this condition, by controlling the increasing tendency of the injector current it is possible to make the valve-opening response time To constant under the slowest condition, regardless of variation of the battery voltage (+B) or the operating condition. With regard to cases in the region which the injection time is long and also variation in valve-opening response time of the injector INJ is not a problem at a low engine rpm, such as the case of a cold start, this type of control is not necessary.

As described above, in an injector driver of the first aspect for an internal combustion engine in which power is supplied directly by a the battery B, without using voltage-boosting circuit, because the waveform generator 11 generates a reference current signal that is synchronized to an injector valve signal for causing the injector to inject and that has a current increasing tendency substantially equivalent to an injector current waveform for the case in which a low voltage is applied to the injector, the current detection resistance R3 and the operational amplifier 15 detect the current that flows in the injector INJ, and the comparator 12 compares the reference current signal with the detected current signal and controls the electrical powering of the injector INJ, even if the applied voltage varies (for example, battery voltage variation or coil resistance variation), it is possible to make the valve-opening response time T0 constant, and possible to prevent variation in the injector valve-opening response time T0 caused by variation of the applied voltage (for example, battery voltage variation or coil resistance variation). By doing this, it is possible to improve the air-to-fuel ratio and combustion stability and reduce emissions.

In addition, in the first aspect because it is not necessary to compensate for the amount of variation in the battery voltage (+B), and because feedback control is performed, it is possible to perform control that is more accurate than map compensation.

Although the description of the first aspect is for an injector driver of one injector corresponding to one cylinder in an internal combustion engine, of the injectors INJ of each cylinder, by adjusting the valve-opening response time T0 of the injectors to the injector having the slowest valve-opening response time T0, that is, by using a reference current signal that approximates the injector current waveform for the injector INJ having the slowest valve-opening response time T0 for the injector controllers of the other cylinders as well, it is possible to achieve a uniform valve-opening response time T0 for the injectors INJ between the cylinders.

In the first aspect, by making the electrical current powering the injector INJ constant and preventing variation in the valve-opening response time T0, it is possible to accommodate variation in the applied voltage. As a result, compensation of the injection starting time and electrical powering time with respect to a change in fuel pressure can be done in the ECU 2 by a map or the like.

Figure 7:
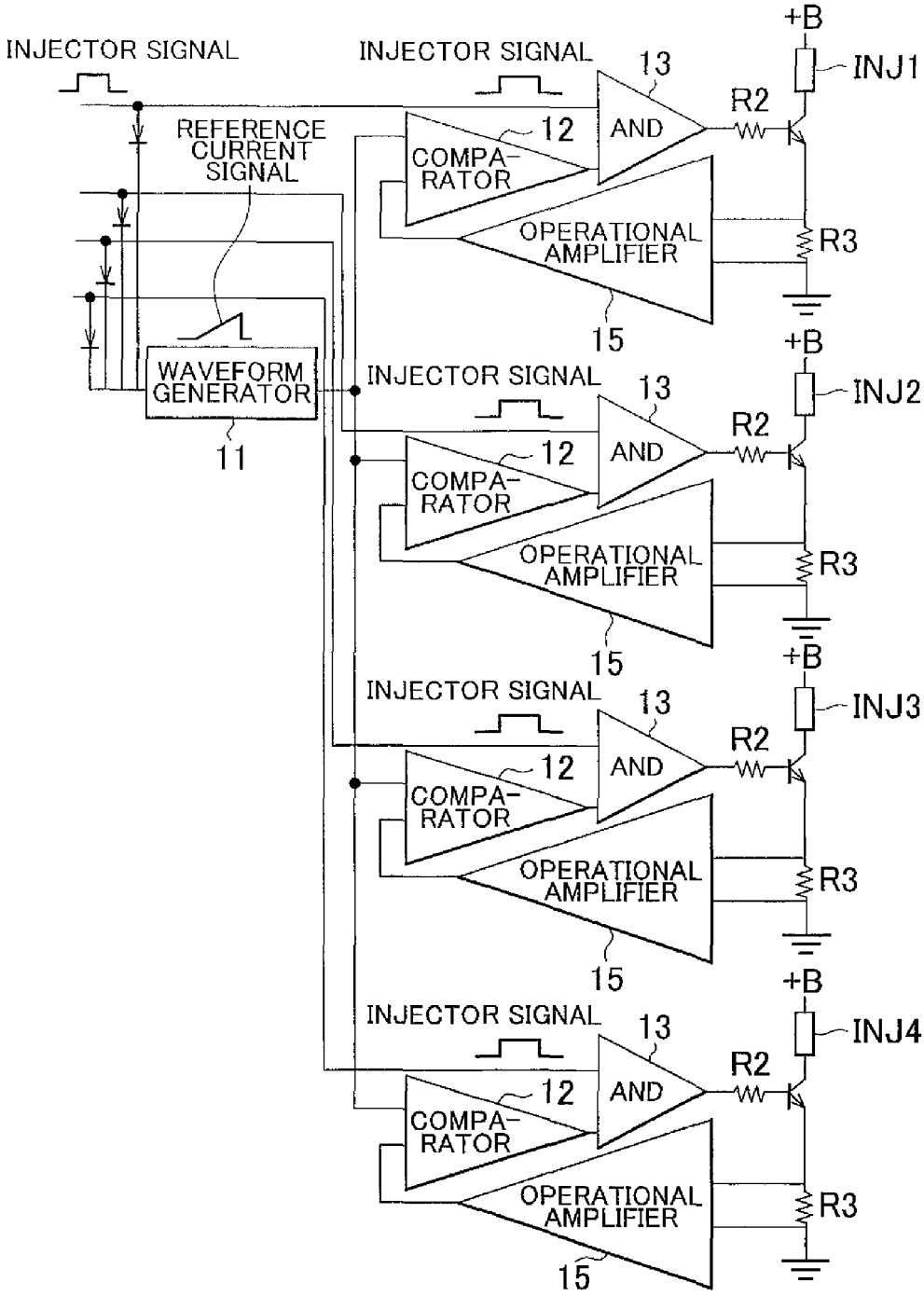
FIG. 7 describes the general configuration of an injector apparatus according to a second aspect of the present invention.
Figure 8A:
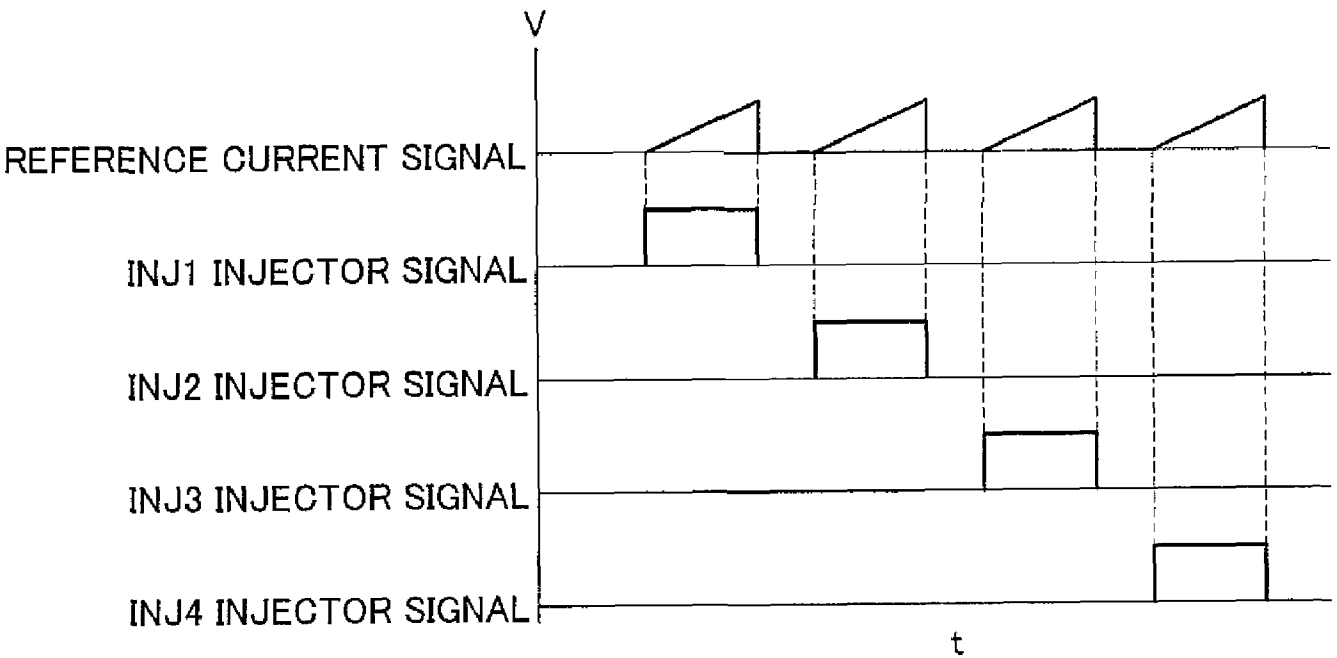
FIG. 8A shows an example of a timing chart of the INJ signal and the reference current signal of each injector (part 1)

FIG. 7 shows the configuration of an injector driver according to the second aspect of the present invention. In FIG. 7 functions equivalent to those in FIG. 1 are assigned the same reference numerals. The injector driver of the second aspect uses a common waveform generator 11 in the case in which the width of each INJ signal for the injectors INJ of each cylinder is the same. This drawing shows the example of four cylinders. In FIG. 7, in the case in which the INJ signal widths of the injectors INJ1 to INJ4 are the same and the attraction forces and fuel pressures for the injectors INJ1 to INJ4 are the same with respect to current, because it is possible to use a common reference current signal, there is no need to provide a waveform generator for each cylinder (injector INJ), and it is possible to have one waveform generator 11 serve for all. FIG. 8A shows an example of a timing chart of the INJ1 to INJ4 signals and the reference current signal of each injector. For example, as shown in FIG. 8A, in the case in which the INJ signals do not overlap, a single waveform generator 11 can generate the reference current signals for each of INJ1 to INJ4.

Figure 8B:
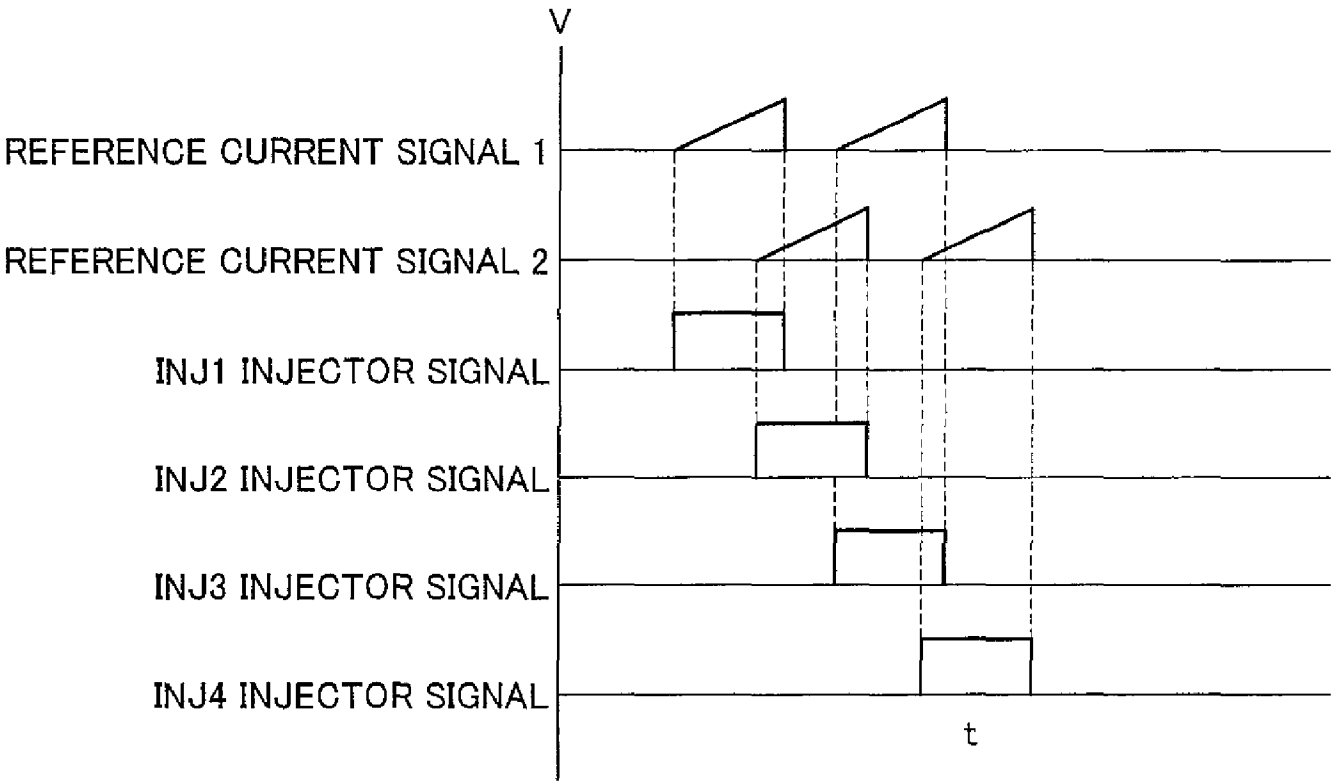
FIG. 8B shows an example of a timing chart of the INJ signal and the reference current signal of each injector (part 2)

Also, if the INJ signals overlap, depending upon the cylinder, because a single waveform generator 11 cannot generate the reference current signal for each cylinder, it is necessary to provide a plurality of waveform generators to the extent that there is no overlap of the INJ signals. FIG. 8B shows an example of a timing chart of the INJ signal and the reference current signal of each injector INJ1 to INJ4. For example, in the case of INJ1 to INJ4 as shown in FIG. 8B, two waveform generators, one for INJ1 and INJ3, and one for INJ2 and INJ4, are required.

Because the second aspect uses a common waveform generator for the injectors of cylinders, it enables an injector driver with a low-cost configuration.

Figure 9:
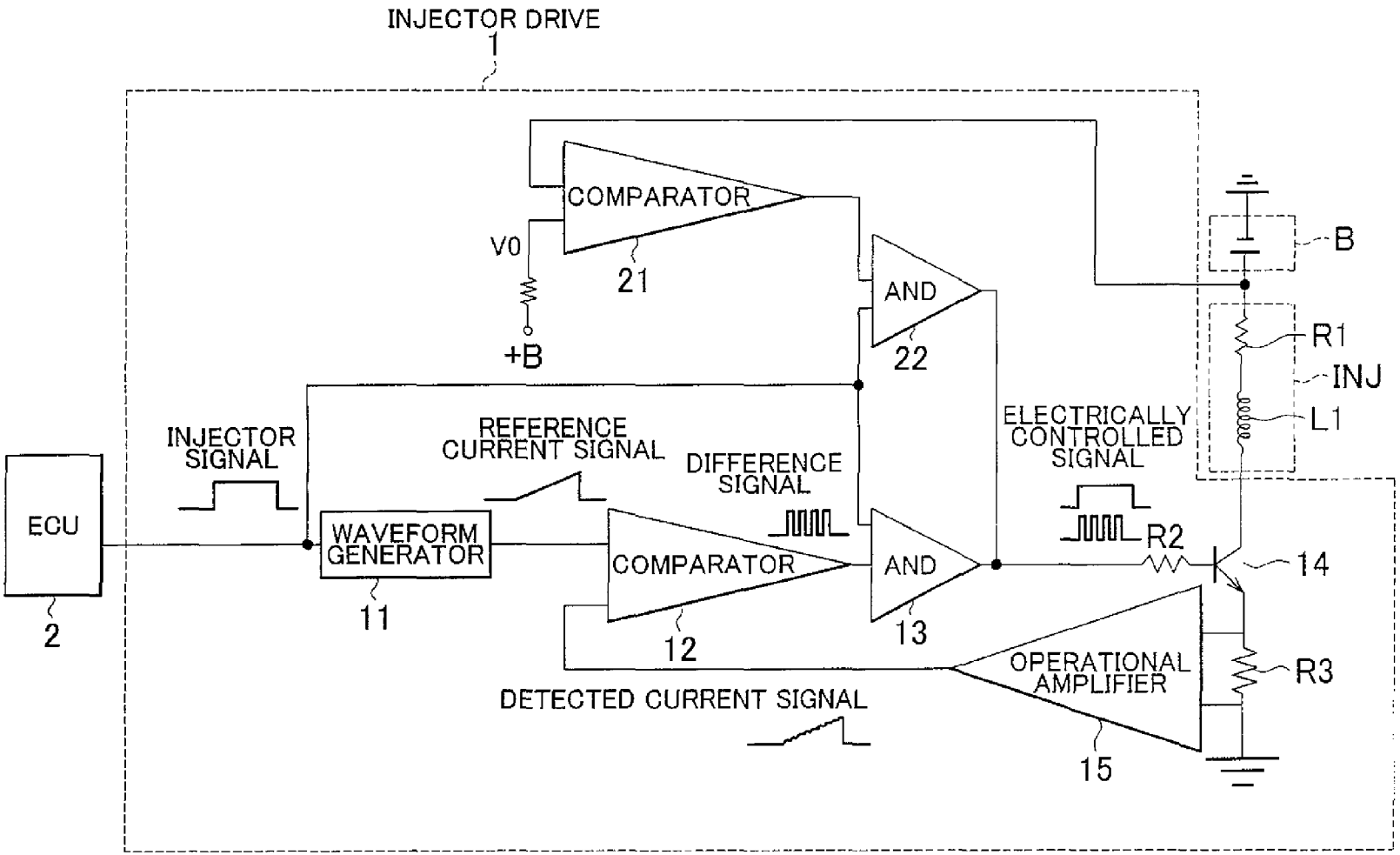
FIG. 9 shows the general configuration of an injector apparatus according to a third aspect of the present invention.
Figure 10:
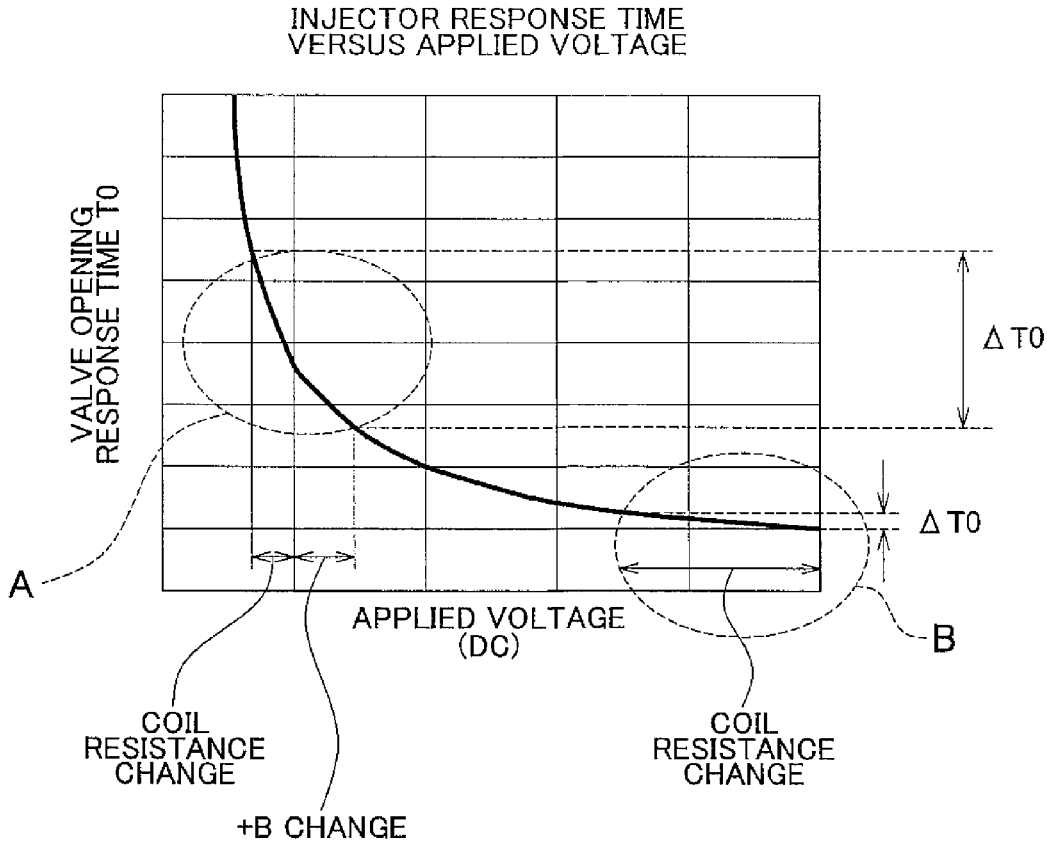
FIG. 10 PRIOR ART
FIG. 10 describes the relationship between the voltage applied to the injector and the valve-opening response time T0 of the injector.
Figure 11:
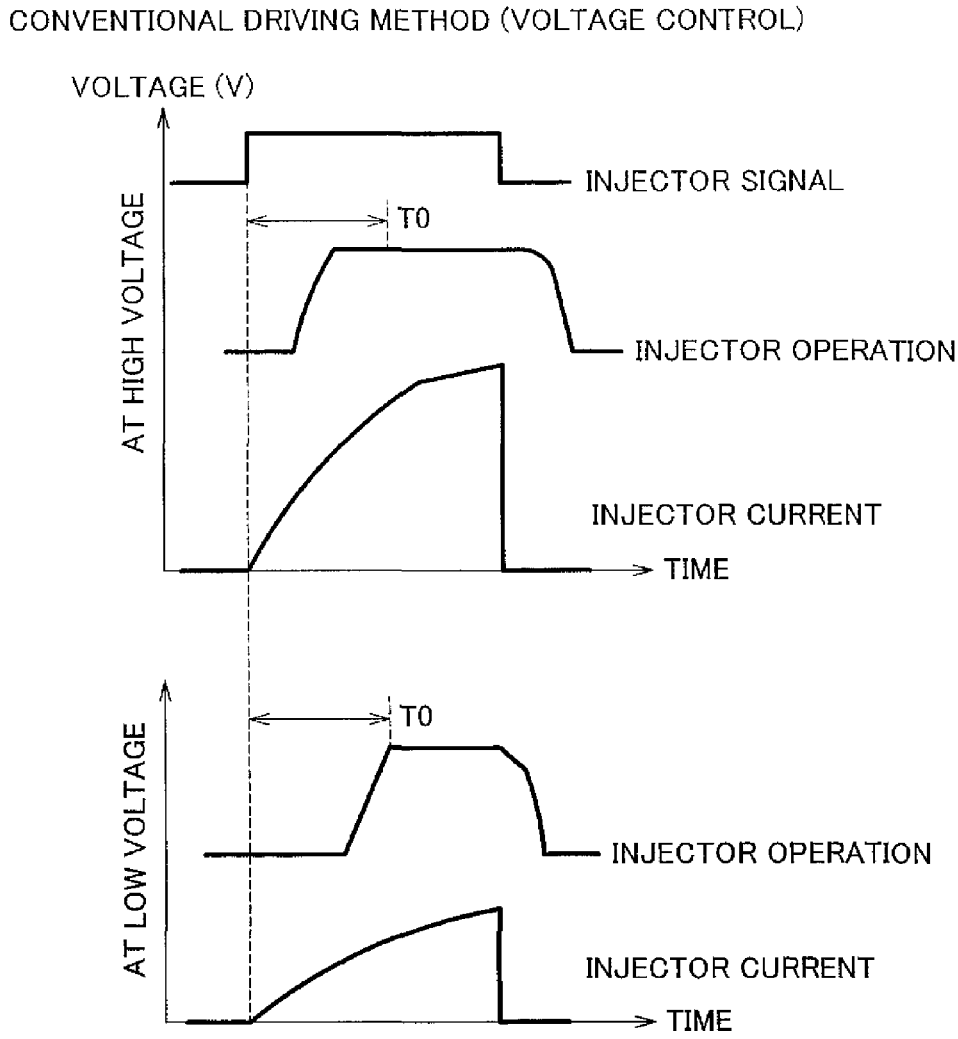
FIG. 11 PRIOR ART
FIG. 11 describes the valve-opening response time T0 of the injector for the case of controlling the injector with a constant current.
Figure 12:
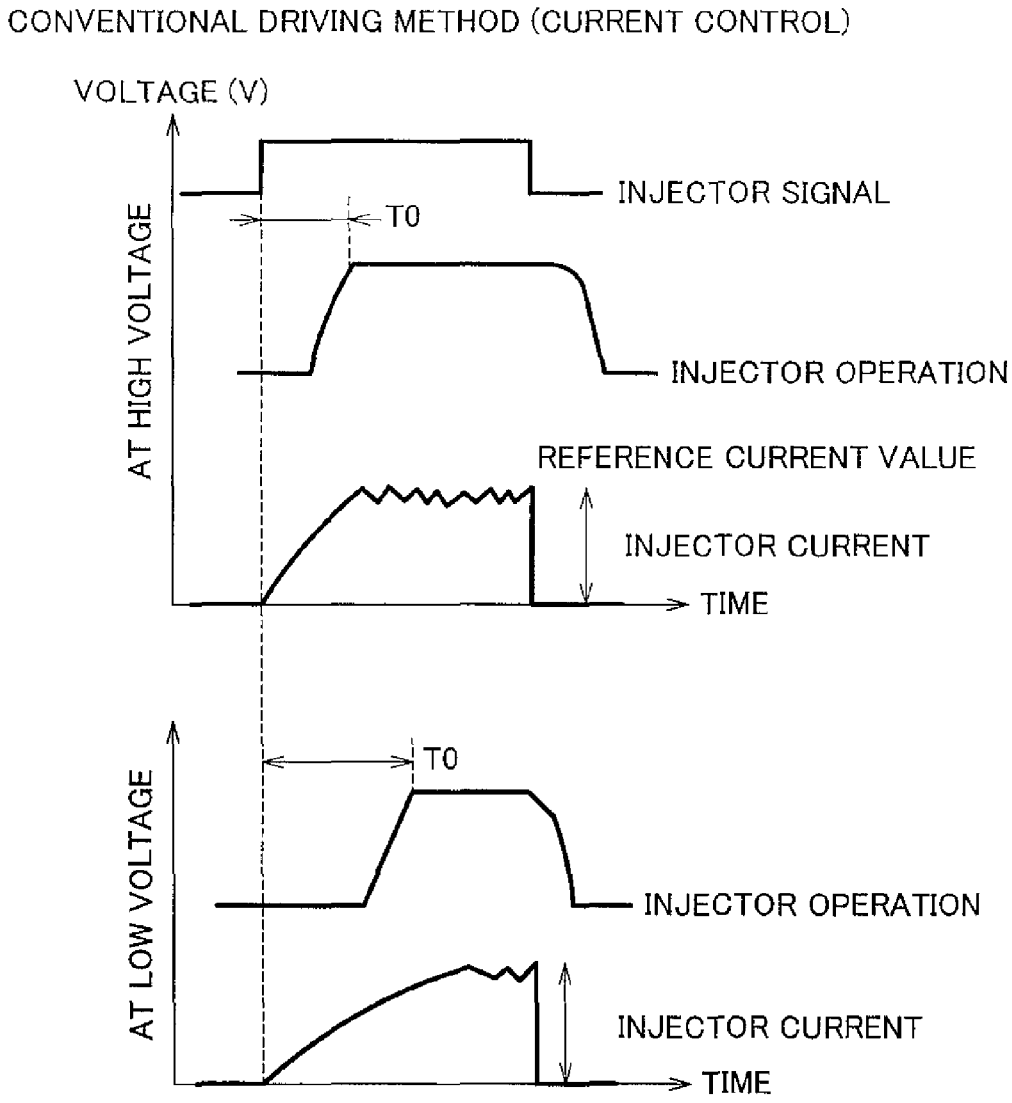
FIG. 12 PRIOR ART
FIG. 12 describes the valve-opening response time T0 of the injector for the case of controlling the injector with a constant voltage.

FIG. 9 shows the configuration of an injector driver according to the third aspect. In the injector driver of the third aspect, in contrast to the first aspect, in the case in which the battery voltage (+B) is equal to or less than a threshold value, the injector INJ is controlled not as an electrical power control signal based on a comparison between the battery voltage (+B) and the detected current signal, but rather as an electrical power control signal having a constant voltage value (INJ signal). In FIG. 9, locations having the same functions as in FIG. 1 are noted by the same reference numerals. In a case such as a cold start, when the battery voltage is greatly reduced, because the lowest speed of current rise that is set in the third aspect is not reached, control is performed to power the injector INJ by a constant voltage.

The injector driver according to the third aspect includes a comparator 21 that compares the battery voltage (+B) with a threshold value V0 (where V0<V1) and outputs H if the battery voltage (+B) is less than or equal to the threshold voltage V0, and L if the battery voltage (+B) is greater than the threshold voltage V0, and an AND circuit 22 that outputs the AND of the output of the comparator 21 and the INJ signal to the power transistor 14 via the protective resistance R2. In this configuration, in the case in which the battery voltage (+B) is less than or equal to the threshold voltage V0, the electrical powering of the injector INJ is done not by an electrical power control signal based on the comparison of the reference current signal and the detected current signal by the comparator 12, but rather based on the INJ signal output from the AND circuit 22. In the case in which the battery voltage (+B) is greater than the threshold signal V0, the electrical powering of the injector INJ is done by an electrical power control signal based on the comparison of the detected current signal with the reference current signal by the comparator 12. In this case, if the battery voltage (+B) is less than or equal to the threshold voltage V0, the injector INJ is controlled at a constant voltage until the battery voltage (+B) is greater than the threshold value V0. In the case in which the battery voltage (+B) is less than or equal to the threshold value V0, after performing constant-voltage control for a given amount of time, control may be performed of the injector INJ based on a comparison of the detected current signal with the reference current signal.

According to the third aspect, because control of the powering of the injector is done by a constant voltage in the case in which the battery voltage (+B) is less than or equal to the threshold voltage V0, it is possible to achieve stability.

Although the injector driver according to the present invention is suitable for use in direct cylinder injected engines, it can also be used in other types of engines.

The injector driver according to the present invention can be used in various types of internal combustion engine for vehicles and the like, and is particularly suited to direct cylinder injected type engines for vehicles and the like.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. An injector driver for driving an injector of an internal combustion engine to which a battery directly supplies power, comprising:

a reference current signal generator that generates a reference current signal that is synchronized to an injector valve signal for causing the injector to inject and that has a current increasing tendency substantially equivalent to an injector current waveform for the case in which a low voltage is applied to the injector;

a current detector that detects the current that flows in the injector as a detected current signal; and an electrical power controller that controls the electrical powering of the injector by comparing the reference current signal with the detected current signal.

2. The injector driver according to claim 1, wherein the reference current signal has a waveform tending to rise at a leading edge of the injector valve signal and to fall at a trailing edge thereof.

3. The injector driver according to claim 2, wherein the reference current signal, after exceeding a first current value, makes a step change to a second current value that is set lower than the first current value.

4. The injector driver according to claim 2, wherein the reference current signal is a waveform approximating the injector current waveform using a triangular wave.

5. The injector driver according to claim 1, wherein the reference current signal, after exceeding a first current value, makes a step change to a second current value that is set lower than the first current value.

6. The injector driver according to claim 1, wherein the reference current signal has a waveform substantially equivalent to an injector current waveform when electrically powering the injector at a low battery voltage and also under a prescribed condition.

7. The injector driver according to claim 1, wherein the reference current signal is a waveform approximating the injector current waveform using a triangular wave.

8. The injector driver according to claim 1, wherein the reference current signal generator is common to the injectors of the cylinders.

9. The injector driver according to claim 8, wherein the electrical power controller controls the electrical powering of the injector at a constant voltage when the battery voltage is equal or lower than a threshold value.

10. The injector driver according to any one of claim 1, wherein the reference current signal generator is provided individually with regard to the injectors of the cylinders.

11. The injector driver according to claim 10, wherein the electrical power controller controls the electrical powering of the injector at a constant voltage when the battery voltage is equal to or lower than a threshold value.

12. The injector driver according to claim 1, wherein the electrical power controller controls the electrical powering of the injector at a constant voltage when the battery voltage is equal to or lower than a threshold value.

13. A driving method of an injector driver for driving an injector of an internal combustion engine to which a battery directly supplies power, comprising:

generating a reference current signal that is synchronized to an injector valve signal for causing the injector to inject and that has a current increasing tendency substantially equivalent to an injector current waveform for the case in which a low voltage is applied to the injector;

detecting the current that flows in the injector as a detected current signal; and controlling the electrical powering of the injector by comparing the reference current signal with the detected current signal.

* * * * *